United States Patent [19]

Denucci

[11] 4,402,167

[45] Sep. 6, 1983

[54] PANEL FASTENING STRUCTURE

[75] Inventor: John F. Denucci, Roberts, Wis.

[73] Assignee: The Vollrath Company, Sheboygan, Wis.

[21] Appl. No.: 222,487

[22] Filed: Jan. 5, 1981

[51] Int. Cl.[3] ..... E04B 2/82; E04B 1/90; E04B 1/41

[52] U.S. Cl. ..... 52/426; 52/127.9; 52/562; 52/309.11; 52/713

[58] Field of Search ..... 52/127, 713, 562, 580, 52/804, 309.11, 426, 404, 802, 428, 427, 699, 127.9; 249/219, 216, 40

[56] References Cited

U.S. PATENT DOCUMENTS

| | | | |
|---|---|---|---|
| 1,482,086 | 1/1924 | Mayworm | 248/254.6 |
| 1,763,034 | 6/1930 | Bunker | 248/200.1 |
| 2,350,113 | 5/1944 | Hurley | 248/200.1 |
| 2,585,082 | 2/1952 | Bollinger | 52/804 |
| 2,622,710 | 12/1952 | Haas | 52/404 |
| 2,851,874 | 9/1958 | Carlson | 52/426 |
| 3,683,577 | 8/1972 | Spillman | 52/427 |
| 3,760,548 | 9/1973 | Sauer | 52/404 |
| 3,932,976 | 1/1976 | Steel | 52/309.9 |
| 4,029,288 | 6/1977 | Murphy | 249/216 |

*Primary Examiner*—John E. Murtagh

*Attorney, Agent, or Firm*—Dressler, Goldsmith, Shore, Sutker & Milnamow, Ltd.

[57] ABSTRACT

A device is provided for locking together adjacent pairs of insulated panels for forming walls of walk-in refrigerators, freezers, and the like. Each panel comprises a pair of spaced-apart, parallel, metal wall members. At each end of the panel each panel wall member has a channel along each margin. A latch or strike assembly is disposed between the wall members at each end of the panel and is adapted to engage a mating strike or latch assembly, respectively, of an adjacent panel. A first pair of tubular fastening members are secured to each latch or strike assembly and engaged with the channel of one of the panel wall members. A first pair of planar fastening members are engaged with the channel of the other wall member and are slidably received in the first pair of tubular fastening members. A projection on each of the tubular fastening members engages a receiving aperture on each of the planar fastening members thereby positioning the fastening members and restraining the panel wall members from relative movement towards or away from each other.

3 Claims, 6 Drawing Figures

PANEL FASTENING STRUCTURE

DESCRIPTION

1. Technical Field

This invention relates to fasteners for insulated panels which can be used to form, among other things, the walls of walk-in refrigerators, freezers, and the like.

2. Background of the Invention

Walk-in refrigerator and freezer walls are often constructed by placing prefabricated panels together, end-to-end, to form the walls of the desired lengths. Typically, these panels consist of two spaced-apart, parallel, exterior skins defining an interior volume that is filled with polyurethane foam insulation. Typical of such insulated panels are those illustrated and described in the U.S. Pat. Nos. 3,353,314 and 3,496,692.

Because the panels are placed end-to-end for forming the walls, a suitable coupling device must be provided for connecting or locking the panels together. Further, as a means for complying with certain fire codes and standards in effect in the United States of America, it would be desirable to provide some type of fastening mechanism for holding the exterior skins parallel to each other at a predetermined spaced-apart distance.

Present devices for holding such skins together require bolts, pins, or metal straps. All require considerable manual work in order to assemble the panel. With some panels, two separate devices are required: one to hold the spaced-apart skins parallel and another to lock the panels together end-to-end for forming the walls of the refrigerator or freezer structure. Examples of lock mechanisms are disclosed in the U.S. Pat. Nos. 3,191,244 3,671,006, and 3,784,240.

It would be advantageous to provide a single device that would both fasten the exterior skins of the panel together and lock the panel to a mating panel to form a wall.

It would be desirable if such a device could be easily mounted in the panel without bolts, pins, metal straps, or other additional mechanisms.

SUMMARY OF THE INVENTION

In accordance with a preferred embodiment of the present invention, a panel locking device, such as a latch or strike mechanism, is provided with two tubular receiving members, one mounted at the top and one mounted at the bottom of the device. The receiving members are adapted to engage a channel along one edge of a skin or wall member forming one side of an insulated panel assembly.

Two planar fastening members are provided which are adapted to engage a channel along one edge of the opposing skin or wall member of the panel assembly. The planar fastening members each have a receiving cavity which is adapted to receive a protuberance projecting from the tubular receiving members. Thus, when the planar fastening members are inserted into the receiving members, the protuberance of each tubular member engages the receiving cavity of the mating planar fastening member and locks the members together. Furthermore, the latch or strike mechanism is thus properly mounted in the panel assembly, ready to engage a complementary device on a mating panel assembly to form a wall.

BRIEF DESCRIPTION OF THE DRAWINGS

In the accompanying drawings forming part of the specification, in which like numerals are employed to designate like parts throughout the same, and in which letters are appended to identical numbers to designate identical features among a plurality of similar structures.

DESCRIPTION OF THE PREFERRED EMBODIMENT

Figure 1:
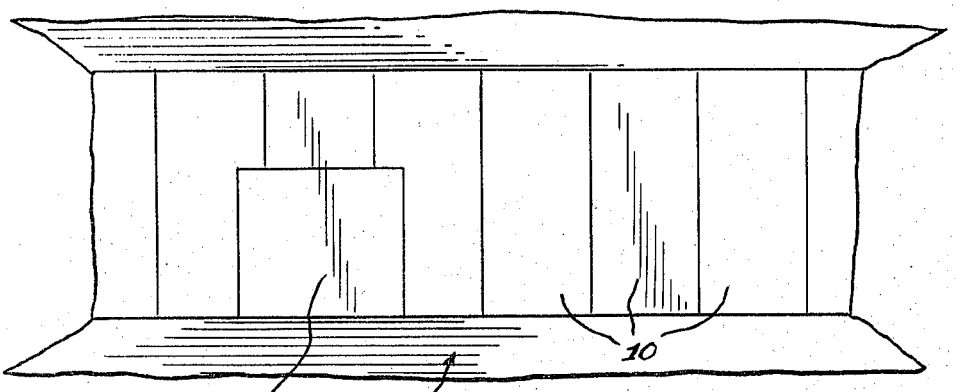
FIG. 1 is a side view of a wall of a walk-in refrigerator which is formed by locking together multiple panel assemblies in end-to-end relationship.

While the invention is susceptible of embodiment in many forms, there are shown in the drawings and will herein be described in detail a preferred embodiment of the invention. It should be understood, however, that the present disclosure is to be considered an exemplification of the principles of the invention and is not intended to limit the invention to the embodiment illustrated.

The precise shapes and sizes of the components herein described are not essential to the invention unless otherwise indicated, since the invention is described with reference to an embodiment which is simple and straightforward.

For ease of description, the apparatus of this invention will be described in a normal installation position and terms such as upper, lower, horizontal, vertical and the like will be used with reference to its normal installation position. It will be understood, however, that the apparatus of this invention may be manufactured, stored, transported, and sold in an orientation other than the normal installation position described.

Referring now to the drawings, FIG. 1 shows a sidewall 8 of a walk-in refrigerator having a door 9. The wall 8 is formed by joining together, end-to-end, a plurality of insulated panel assemblies 10. The panel assemblies 10 are connected together in series to form the wall of the desired size. To facilitate this, each panel assembly 10 is provided with a mechanism on each end for engaging the adjacent mating panel assemblies.

Figure 2:
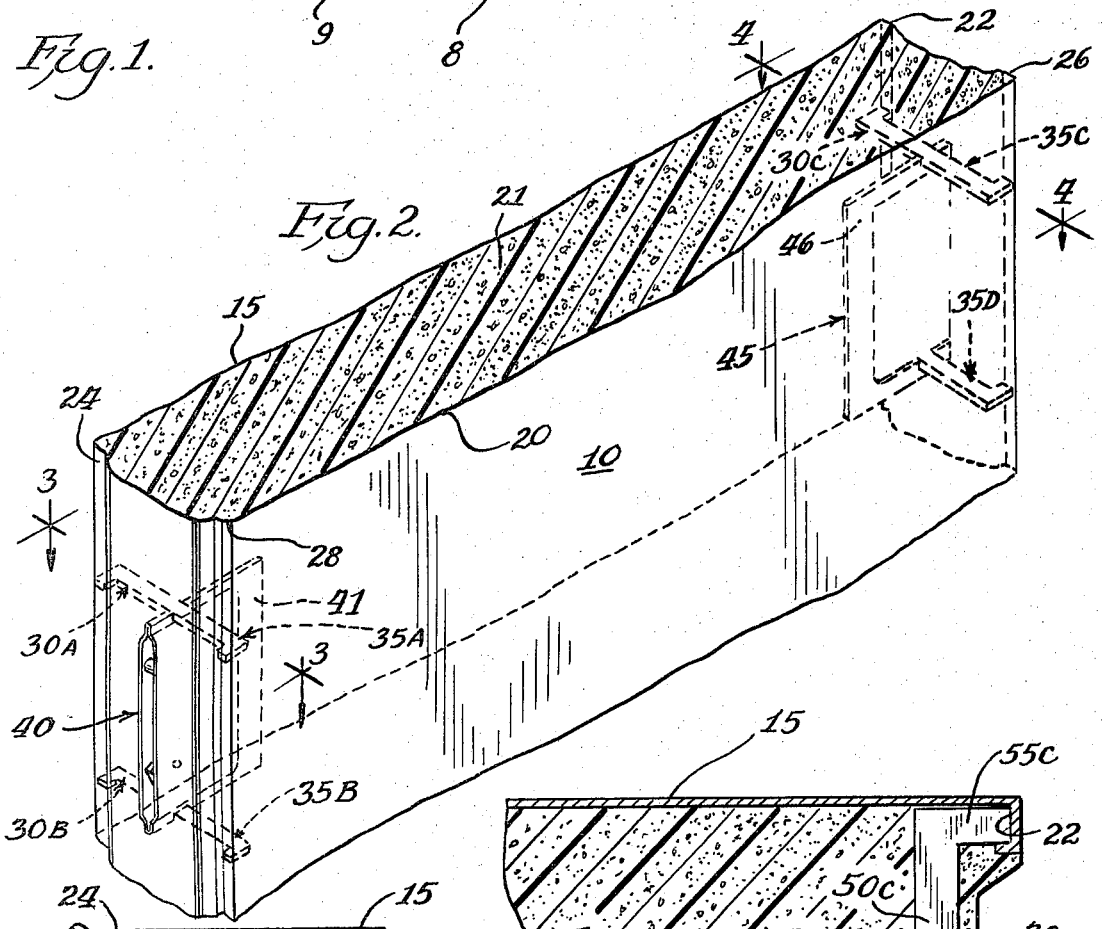
FIG. 2 is an enlarged, fragmentary, perspective view of an individual panel assembly.

A single panel assembly 10, shown in greater detail in FIG. 2, is formed by a pair of spaced-apart, parallel, first and second wall members or exterior panel skins 15 and 20. The wall members 15 and 20 are typically metal and encase a suitable insulation, such as polyurethane foam 21.

Figure 3:
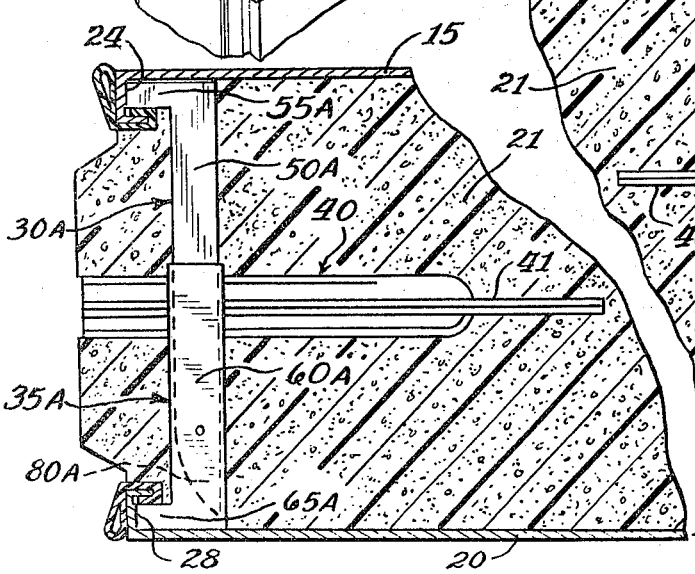
FIG. 3, taken generally along the plane 3—3 of FIG. 2, is an enlarged, fragmentary, cross-sectional view of the latch assembly and panel skin fastening structure.
Figure 4:
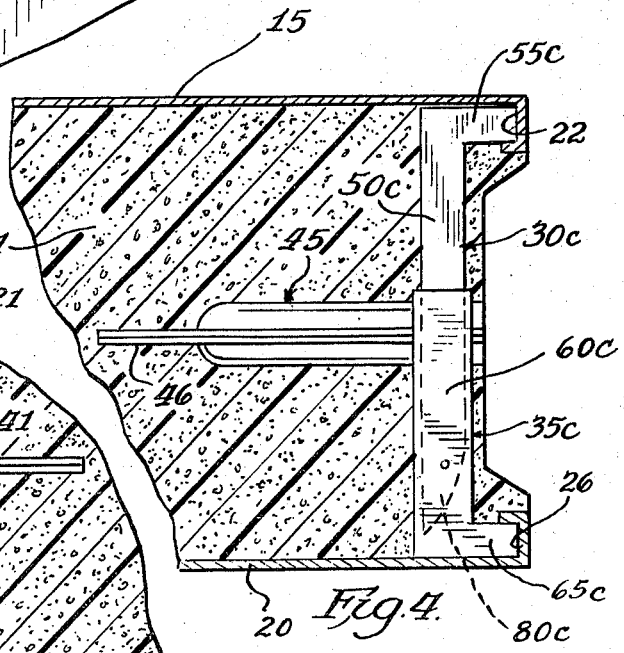
FIG. 4, taken generally along the plane 4—4 of FIG. 2, is an enlarged, fragmentary, cross-sectional view of the strike assembly and panel skin fastening structure.

As best illustrated in FIGS. 3 and 4, a first wall member 15 defines a channel or return bend 22 along the margin of one of its two ends and a channel or return bend 24 along the margin of the other of its ends. Likewise, second wall member 20 defines a channel or return bend 26 along one of its two ends and a channel or return bend 28 along the other of its ends.

As best illustrated in FIG. 2, a latch mechanism or latch 40 is mounted within the panel assembly 10 at one end of the assembly 10 and a strike mechanism or strike 45 is mounted within the panel assembly 10 at the other end.

The latch 40 and strike 45 are conventional mechanisms typically used with insulated panel assemblies similar to the assembly 10 described herein. The latch 40 is adapted to engage a strike 45 of an adjacent panel when the panels are aligned in end-to-end relationship to form a wall of a walk-in refrigerator, freezer, or the like. The structure and internal mechanisms of the latch 40 and of the strike 45 may be as found in conventional latches and strikes that are well known in the art and a detailed description is not presented here.

The internal mechanisms of the latch 40 are contained within the latch housing that has a peripheral flange 41. Similarly, the housing of strike 45 has a peripheral flange 46. It is through these flanges that the latch and strike assembly are securely held within the panel assembly 10 as will be explained in detail hereinafter.

Figure 5:
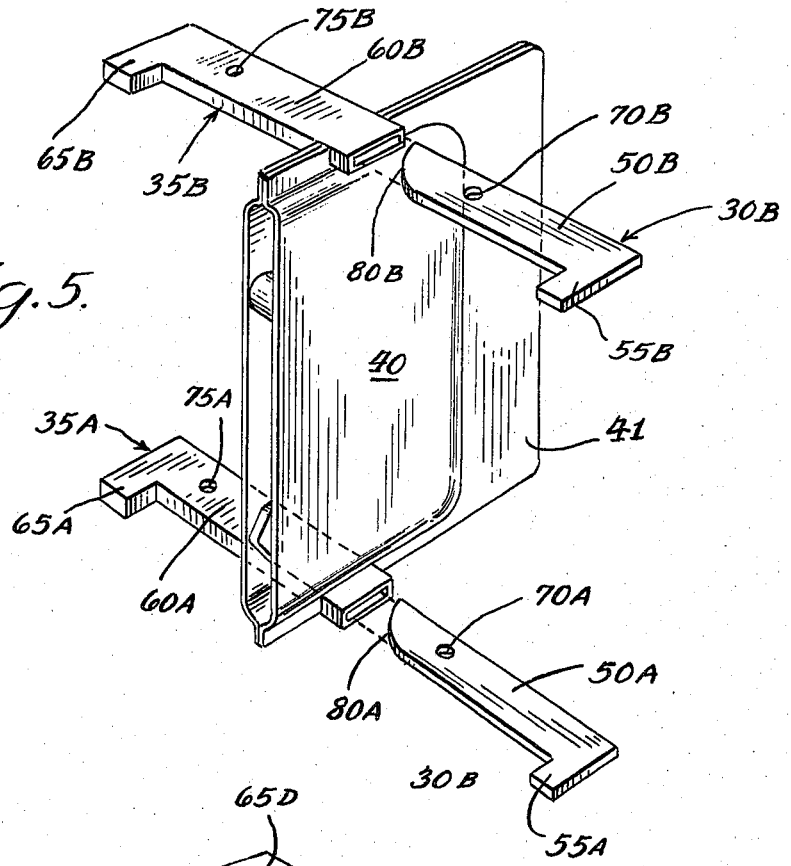
FIG. 5 is an exploded, perspective view of the latch assembly and panel skin fastening structure of FIG. 2 shown upsidedown with the insulation and panel skins removed for clarity.

As best illustrated in FIGS. 2, 3, and 5, the first or tubular fastening members 35A and 35B are mounted to the flange 41 at opposite ends of the latch 40. In FIG. 5, the latch 40 has been turned upsidedown to better illustrate the structure of the tubular fastening members 35A and 35B.

Tubular fastening member 35A includes a first, generally straight portion 60A and a second, projecting portion 65A giving tubular fastening member 35A a generally L shape. As can be seen from FIG. 3, projecting portion 65A is adapted to engage channel 28 in wall member 20. Tubular fastening member 35A also has an inwardly projecting dimple or protuberance 75A on one side (FIG. 5) adapted to be received in a receiving cavity of another member as will be explained in detail hereinafter. Though not illustrated, a similar protuberance may be provided on the other side of the tubular fastening member, opposite protuberance 75A.

Tubular fastening member 35B is identical to tubular fastening member 35A, and the numbered elements of fastener 35B correspond to the like numbered elements of fastener 35A.

Planar, or second fastening members 30A and 30B are provided to connect with tubular fastening members 35A and 35B, respectively, as best illustrated in FIGS. 3 and 5. Planar fastening member 30A includes a generally straight portion 50A and a projecting portion 55A giving it a generally L shape. As best illustrated in FIG. 3, projecting portion 55A is adapted to engage channel 24 of wall member 15.

The planar fastening member 30A is adapted to be received within the tubular member 35A as illustrated in FIG. 3. To this end, planar fastening member 30A has a tapered portion 80A.

As best illustrated in FIG. 5, planar fastening member 30A also has an aperture or receiving cavity 70A for engaging the protuberance 75A of the tubular fastening member 35A when the planar fastening member 30A is inserted into the tubular fastening member 35A as illustrated in FIG. 3.

Planar fastening member 30B is identical to planar fastening member 30A, and the numbered elements of fastener 30B correspond to the like numbered elements of fastener 30A.

To fabricate the panel assembly 10, planar fastening members 30A and 30B are positioned in channel 24 of wall member 15 as illustrated in FIG. 3. Tubular fastening members 35A and 35B, attached to latch 40, are positioned in channel 28 of wall member 20. When planar fastening members 30A and 30B are inserted into tubular fastening members 35A and 35B, respectively, protuberances 75A and 75B become engaged in the tubular fastener member cavities 70A and 70B, respectively.

The design of the tubular and planar fastening members is such that the members are sufficiently resilient to permit the necessary flexing of the members as they are engaged. For example, as planar fastening member 30A is inserted into tubular fastening member 35A, the distal or leading end of the planar fastening member 30A forces the projecting protuberance 75A upwardly so that the planar fastening member 30A can pass under it. When the planar fastening member 30A has been inserted in the tubular fastening member 35A a sufficient distance, the receiving cavity 70A of the planar fastening member 30A is aligned in registry with the downward projection 75A of the tubular fastening member 35A. At this point, the projection 75A is urged downwardly, by the inherent resiliency of the tubular fastening member, into engagement with the receiving cavity 70A of the planar fastening member 30A. Tubular member 35B and planar member 30B engage in the same manner. Thus, latch 40 is then properly positioned in panel 10 between wall members 15 and 20 which are maintained at a predetermined spaced-apart distance.

Figure 6:
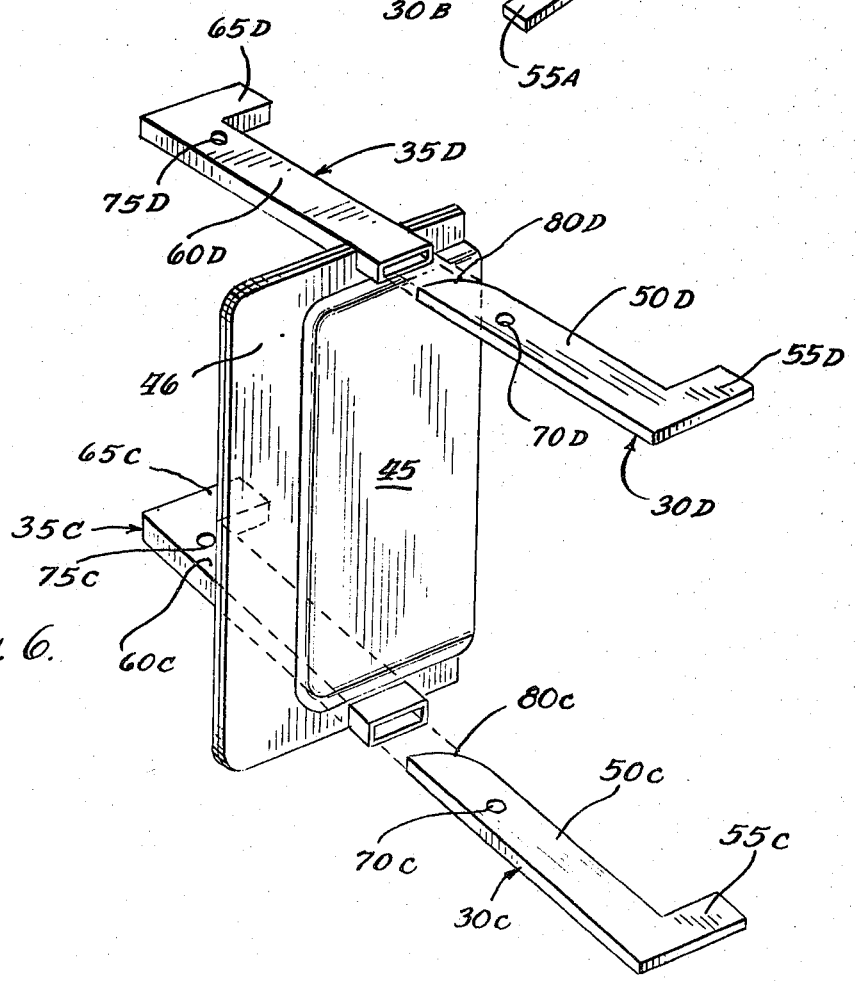
FIG. 6 is an exploded, perspective view of the strike assembly and panel skin fastening structure of FIG. 2 shown upside down with the insulation and panel skins removed for clarity.

The other locking device or strike assembly 45 is best illustrated in FIGS. 2, 4, and 6. In FIG. 6, the strike assembly 45 has been turned upsidedown to better illustrate the structure of tubular fastening members 35C and 35D which are mounted to opposite ends of strike 45 at the peripheral flange 46 of the strike housing. Tubular fastening members 35C and 35D are identical to the tubular fastening members 35A and 35B associated with latch 40 described above. The numbered elements of tubular fastening members 35C and 35D correspond to the like numbered elements of tubular fastening members 35A and 35B.

Planar fastening members 30C and 30D are provided to engage tubular fastening members 35C and 35D, respectively, in the same way that planar fastening members 30A and 30B engage the tubular fastening members 35A and 35B, respectively, on latch 40 described above. Planar fastening members 30C and 30D are identical to planar fastening members 30A and 30B. The numbered elements of planar fastening members 30C and 30D correspond to the like numbered elements of the planar fastening members 30A and 30B, respectively.

To complete fabrication of the panel assembly 10, planar fastening members 30C and 30D are positioned in channel 22 of wall member 15 (FIG. 4). Tubular fastening members 35C and 35D, which are secured to the strike 45, are positioned in channel 26 of wall member 20. The wall members 15 and 20 are then moved so that the planar fastening members 30C and 30D become inserted into tubular fastening members 35C and 35D, respectively. The protuberances 75C and 75D of the tubular fastening members 35C and 35D, respectively, then engage the cavities 70C and 70D, respectively, of the planar fastening members 30C and 30D, respectively. In this way, planar fastening members 30C and 30D and tubular fastening members 35C and 35D are locked together. Thus, the strike 45 is then properly positioned in panel 10 between wall members 15 and 20 which are maintained at a predetermined spaced-apart distance.

When the wall members 15 and 20 are maintained apart at each end of the panel 10 by means of the fastening members, the wall members 15 and 20 are substantially parallel and define between them an interior volume which is then filled by conventional techniques with suitable insulation, such as urethane foam 21.

The insulation 21 makes the panel 10 more rigid and encapsulated all but the fronts of latch 40 and strike 45 to thus securely hold latch 40 and strike 45 in their proper positions in the panel ends.

The planar fastening members 30A, 30B, 30C and 30D are designed to reduce the transmission of heat through the panel assembly 10. That is, it is desired that the cold interior side of the panel assembly be insulated from the exterior side of the panel assembly. Thus, it is preferable to reduce the thermal conductivity of the structure connecting the wall members of each panel. To this end, the planar fastening members 30A, 30B, 30C and 30D are preferably made of a material that is a relatively poor conductor of heat, such as fiberglass. The tubular fastening members 35A, 35B, 35C, and 35D are preferably fabricated from a metal so that they can be welded to the latch and strike housing flanges.

From the foregoing, it will be observed that numerous variations and modifications may be effected without departing from the true spirit and scope of the novel concept of this invention. It is to be understood that no limitation with respect to the specific apparatus illustrated herein is intended or should be inferred. It is, of course, intended to cover by the appended claims all such modifications as fall within the scope of the claims.

What is claimed is:

1. An improvement in a locking device for a panel assembly wherein said locking device is adapted to be disposed at one end of said panel assembly and wherein said panel assembly has an opposed pair of generally flat, spaced-apart, first and second wall members each defining a channel along opposed margins of the panel assembly at one end, said improvement comprising:

(a) a first fastening member secured to said locking device and adapted to engage said channel of said first wall member;

(b) a second fastening member adapted to engage said channel of said second wall member and adapted to engage said first fastening member; and (c) means on said first and second fastening members for maintaining the position of said first and second fastening members relative to each other when engaged to thereby maintain said wall members in spaced-apart relationship, each of said first and second fastening members having a first and second portion arranged in a generally L-shaped configuration with one of said portions adapted to be received in said channel of one of said wall members.

2. An improvement in a two-ended panel assembly in which the panel assembly includes a pair of spaced-apart first and second flat wall members each having a return bend along each margin of the wall member at each end of the panel assembly, said improvement comprising:

(a) a strike assembly disposed between said wall members at one end of said panel assembly and adapted to engage a mating latch assembly in an adjacent panel assembly;

(b) a first pair of tubular fastening members secured to said strike assembly and engaged with said return bend of said first wall member at one end of said panel assembly;

(c) a first pair of planar fastening members engaged with said return bend of said second wall member at said one end of said panel assembly and slidably received in said first pair of tubular fastening members on said strike assembly;

(d) each of said first pair of planar fastening members defining a receiving cavity; and (e) each of said first pair of tubular fastening members having a projection received in one of said receiving cavities of one of said first pair of planar fastening members thereby positioning said fastening members to restrain said first and second wall members from relative movement toward or away from each other at said one end of said panel assembly with said strike assembly positioned between said first and second wall members.

3. The improvement in accordance with claim 2 further including:

(a) a latch assembly disposed between said wall members at the other end of said panel assembly and adapted to engage a mating strike assembly in another adjacent panel assembly;

(b) a second pair of tubular fastening members secured to said latch assembly and engaged with said return bend of said first wall member at said other end of said panel assembly;

(c) a second pair of planar fastening members engaged with said return bend of said second wall member at said other end of said panel assembly and slidably received in said second pair of tubular fastening members on said latch assembly;

(d) each of said second pair of planar fastening members defining a receiving cavity; and (e) each of said second pair of tubular fastening members having a projection received in one of said receiving cavities of one of said second pair of planar fastening members thereby positioning said second pairs of fastening members to restrain said first and second wall members from relative movement toward or away from each other at said other end of said panel assembly with said latch assembly positioned between said first and second wall members.

* * * * *